US005439019A

United States Patent [19]

Quandt et al.

[11] Patent Number: 5,439,019

[45] Date of Patent: Aug. 8, 1995

[54] METHOD AND APPARATUS FOR FILLING A WASH TUB OF AN AUTOMATIC CLOTHES WASHER

[75] Inventors: William J. Quandt, Ripon; Charles O. Tapp, Fond du Lac, both of Wis.

[73] Assignee: Speed Queen Company, Ripon, Wis.

[21] Appl. No.: 141,317

[22] Filed: Oct. 22, 1993

[51] Int. Cl.[6] ..... D06F 33/00

[52] U.S. Cl. ..... 137/2; 137/624.11; 68/12.05; 68/12.22; 236/12.12

[58] Field of Search ..... 137/624.11, 624.15, 137/624.2, 1, 2, 624.18; 68/12.05, 12.21, 12.22; 236/12.11, 12.12, 12.15

[56] References Cited

U.S. PATENT DOCUMENTS

| | | | |
|---|---|---|---|
| 4,330,081 | 5/1982 | McMillan | 68/12.22 X |
| 4,406,401 | 9/1983 | Nettro | 236/12.12 |
| 4,528,709 | 7/1985 | Getz et al. | 236/12.12 X |
| 4,643,350 | 2/1987 | DeSchaaf et al. | 236/12.12 |
| 5,231,722 | 8/1993 | Shacklock et al. | 68/12.22 X |

*Primary Examiner*—Martin P. Schwadron
*Assistant Examiner*—Kevin L. Lee
*Attorney, Agent, or Firm*—William R. Clark

[57] ABSTRACT

Method and apparatus for filling a wash tub of an automatic clothes washer wherein a controller uses a thermistor embedded in the mixing valve to generate and store historical averages of the cold and warm water temperatures. From these, the hot water temperature is calculated under the assumption that the warm water is 50/50 hot and cold. The controller also uses a timer and a pressure sensitive switch to generate and store a historical average of the flow rate. A flow washer helps justify the assumption that the flow rate is always constant. Based on the hot and cold water temperatures and the anticipated flow rate, the controller calculates the ratio of hot and cold water, and how long each must be turned on to provide the selected water level. Then, each water valve is individually controlled for a single extended on cycle to satisfy the final requirements of temperature and level.

23 Claims, 3 Drawing Sheets

METHOD AND APPARATUS FOR FILLING A WASH TUB OF AN AUTOMATIC CLOTHES WASHER

BACKGROUND OF THE INVENTION

The field of the invention generally relates to automatic clothes washers, and more particularly relates to method and apparatus for filling a wash tub with water having a desired temperature and level.

As is well known, automatic clothes washers typically have a control that permits the operator to select a desired water temperature. For example, in the most common arrangement, the operator has only three water temperature choices: cold, warm and hot. If cold is selected, the controller typically opens the cold water valve for the entire filling period. If hot is selected, the controller typically opens the hot water valve for the entire filling period. And if warm is selected, the controller typically opens the hot and cold water valves for the entire filling period to provide a water mixture of intermediate temperature. One problem with this arrangement is that it provides very poor temperature regulation, and thereby results in poor energy efficiency. For example, in average American homes, the water heater is set to about 130° F. The cold water temperature in this same household typically varies between 45° F. and 65° F. as a function of the season. Thus, assuming a cold water temperature of 65° F. and a hot water temperature of 130° F., the warm water selection would result in a water temperature of 97.5° F., assuming the warm setting resulted in a 50/50 mixture of the hot and cold water. If a particular detergent works best at 75° F. and above, selecting a cold water wash (e.g. 45°–65° F.) would typically give poor washing results. However, selecting a warm water wash would typically result in wasting energy. In particular, a large part of the energy consumed in doing a load of laundry is used to heat the water. It is apparent that using 97.5° F. water when 75° F. water is sufficient results in a significant waste of energy.

In another prior art approach for controlling water temperature, a duty cycle was established for the hot and cold water. For example, an intermediate or warm water temperature was provided by cycling the cold water on and off with a duty cycle of 60%, and cycling the hot water on and off with a duty cycle of 40%. Therefore, wash or rinse water was provided at a temperature other than the mid-point between the hot and cold temperatures. However, the resulting temperature could not be accurately regulated to a desired temperature. Further, the on and off cycling caused wear and tear on the water valves, and reduced their life expectancies. Also, the cycling caused water hammer which is an undesirable thumping or pounding noise. The associated water impulse pressures can also lead to pipe and joint fatigue.

In still another prior art approach, a thermistor was positioned at the location where the water enters the wash tub to provide a measure of the temperature of the filling water. In response thereto, the valves were cycled on and off in an attempt to provide a desired temperature for water entering the wash tub. This approach had the same wear and water hammer drawbacks described above with regard to cycling on and off. Also, there was a tendency for this system to overcompensate.

SUMMARY OF THE INVENTION

A primary object of the present invention is to provide an improved system for filling a wash tub of an automatic clothes washer with water of a preselected temperature and level.

It is also an object to provide a system and method for accurately regulating the temperature of the final volume of water. It is a further object to enable the operator to preselect any one of a plurality of intermediate temperatures between hot and cold.

It is a further object to minimize on and off cycling of the hot and cold water valves to reduce wear and tear, and also to minimize water hammer.

It is also an object to improve energy efficiency by enabling the water to be regulated to a temperature sufficient to fully activate the detergent, but not so hot as to waste energy.

It is a further object to provide a water fill system that diagnoses excessive fill times such as may be caused by a broken hose or clogged water screen filter.

In an automatic clothes washer having a wash tub filled by hot and cold water provided through respective hot and cold water valves, a method of filling the wash tub to a preselected level with water at a preselected temperature comprises the steps of determining the time to fill the wash tub to the preselected level with a predetermined flow rate, and determining respective on times of hot and cold water at predetermined temperatures to provide a mixture at the preselected temperature. In accordance with the invention, the method further includes a step of turning on the hot and cold water valves in accordance with the respective on times to fill the wash tub to the preselected level with water at the preselected temperature.

Preferably, the step of determining the time to fill the wash tub comprises a step of determining the predetermined water flow rate by measuring the time to fill to a sensed water level of known water volume on a previous fill operation, and dividing the known water volume by the measured time to fill to that level. The average of a plurality of such measurements may preferably be calculated and stored to provide the predetermined water flow rate. The time to fill the wash tub to the preselected level may be calculated by dividing a water volume corresponding to the preselected level by the predetermined water flow rate.

The step of determining hot and cold water on times may preferably comprise the steps of determining the percentages of hot and cold water at the respective predetermined temperatures that would yield a mixture at the preselected temperature, and then multiplying those percentages by the time to fill the tub to the preselected level.

With such method and corresponding apparatus, very accurate water temperature regulation is provided, and the selected temperature can theoretically be regulated to any temperature between the hot and cold water temperatures. Therefore, the water can be set to a temperature high enough to fully activate a particular detergent, and energy is not wasted by heating water to an unnecessarily high temperature. Using a thermistor embedded in the mixing valve, the controller generates and stores a historical average for the cold water temperature and the warm water temperature which is assumed to be a 50/50 mixture of hot and cold water. From these averages as suitably updated during the current fill operation, the hot water temperature is readily calculated. The controller also generates a historical average for the flow rate based on the times to fill to one or more levels of known water volume or capacity. A flow washer helps to normalize the flow rate thereby justifying the assumption that the flow rate is the same regardless of whether one or both valves are on, and regardless of the input water pressure. Using the hot and cold water temperatures and the flow rate, the controller readily calculates how long the respective hot and cold valves will have to be open in order to fill the wash tub to the selected level with water of the selected temperature. With such arrangement, the total hot and cold water requirements are known or calculated at or near the beginning of a fill operation. Therefore, each water valve can be turned on for a single cycle of extended duration thereby eliminating multiple on and off cycles and the heretofore described disadvantages. Also, if there is an anomaly in the time to fill to a preselected level, the anomaly will be readily apparent because the filling is primarily based on time rather than a pressure switch.

BRIEF DESCRIPTION OF THE DRAWINGS

The foregoing objects and advantages will be more fully understood by reading the following Description of the Preferred Embodiment with reference to the drawings wherein.

DESCRIPTION OF THE PREFERRED EMBODIMENT

Figure 1:
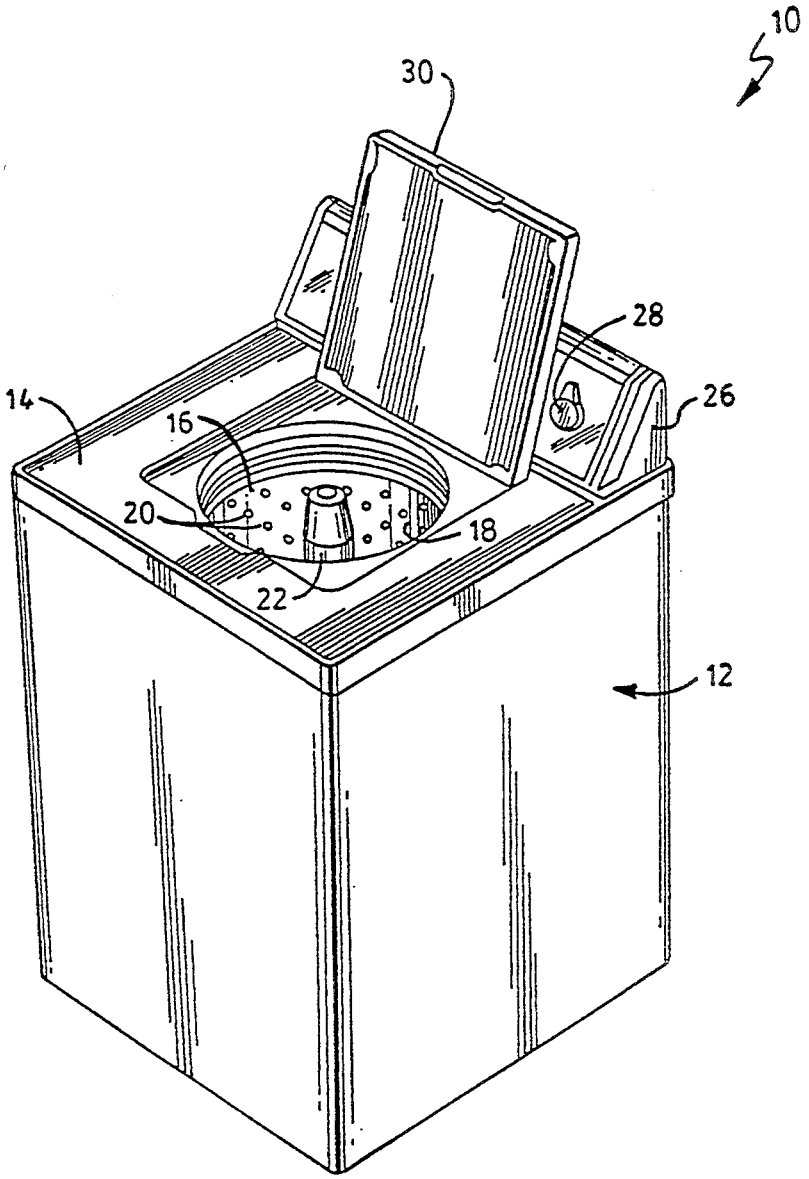
FIG. 1 is a front perspective view of a top-loading automatic clothes washer.

Referring to FIG. 1, a top-loading clothes washer 10 includes a cabinet 12 having a top panel 14 with an access opening 16 down into a spin basket 18 having perforations 20. An agitator 22 is centrally located in spin basket 18. A control console 26 is mounted to the rear of the top panel 14, and includes a plurality of operator actuable control knobs 28. In conventional manner, clothes are loaded into spin basket 18 through access opening 16 and, after lid 30 is closed, control knobs 28 are used to initiate a sequence of automatic cycles or operations. More specifically, in a manner to be described in detail herein, the wash tub 32 (FIG. 2) surrounding spin basket 18 is filled with water of a preselected temperature to a preselected water level. After detergent is added, agitator 22 is activated to wash soil from the clothes. Then, after the wash water is drained from wash tub 32, a spin cycle is executed wherein the spin basket 18 is rotated at a high rate of speed such as 600 r.p.m. to extract water from the clothes. The wash tub 32 is then filled with rinse water of a preselected temperature to a preselected water level for rinsing, followed by another drain and spin operation.

Figure 2:
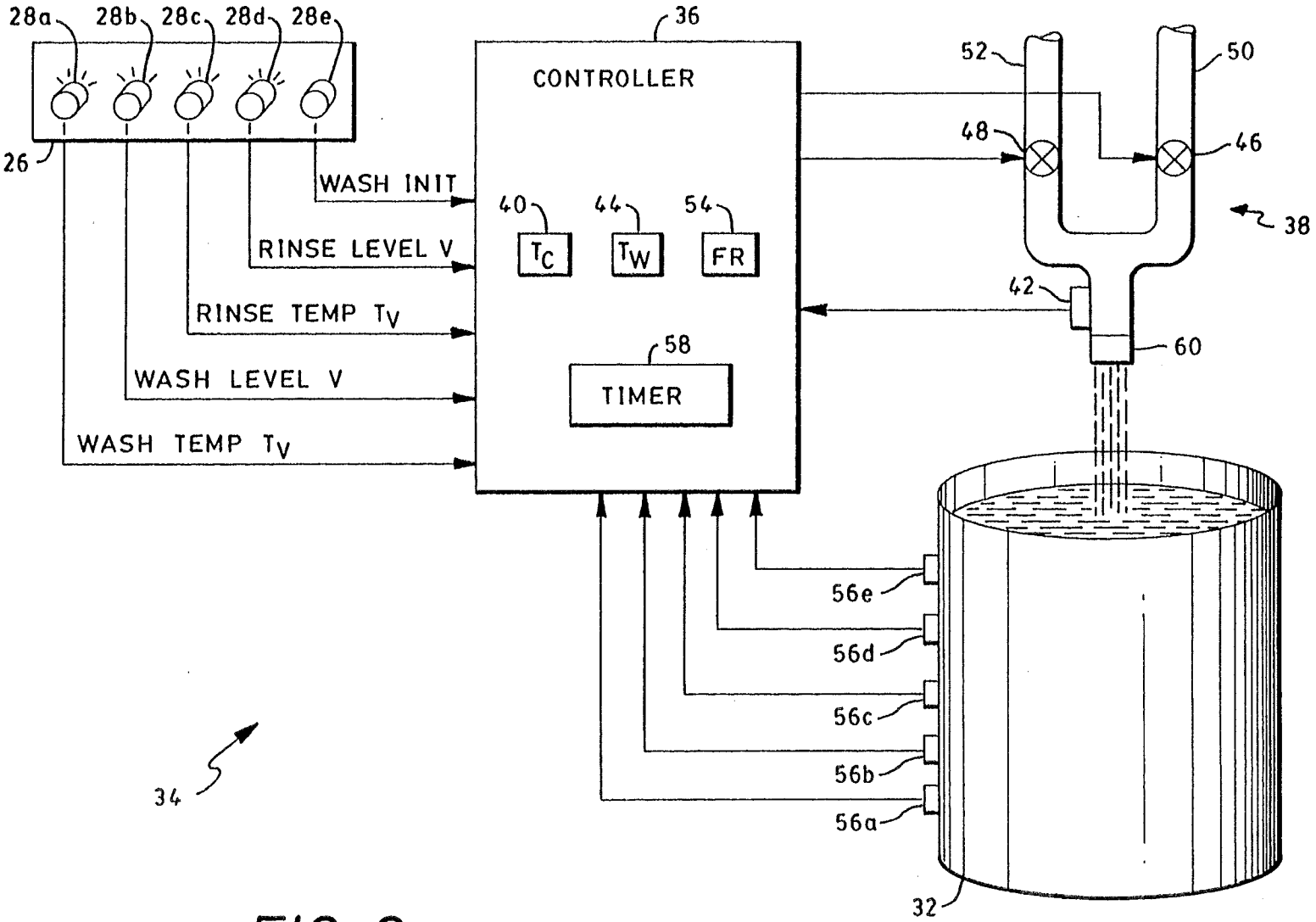
FIG. 2 is a simplified block diagram of a water fill system for the clothes washer of FIG. 1.

Referring to FIG. 2, a simplified block diagram of a water fill system 34 for filling wash tub 32 before a wash or rinse operation is shown. The first step is for the operator to input to controller 36 the desired water temperature and water level for both the wash and rinse operations. Here, separate control knobs 28*a–d* are used for this function. In particular, the operator presets control knob 28*a* to input the desired water temperature ($T_V$) for wash, presets control knob 28*b* to input the desired water level (V) for wash, presets control knob 28*c* to input the desired water temperature $T_V$ for rinse, presets control knob 28*d* to input the desired water level V for rinse, and actuates control knob 28*e* to input a control signal WASH INIT to initiate a sequence of automatic cycles to wash the clothes. Although the control knobs 28*a–e* are here shown as mechanically actuated rotary knobs, it may be preferable to input the control signals using operator actuable electronic controls. Controller 36 here includes an integrated circuit processor capable of executing a software program developed in accordance with the flow diagram of FIG. 3.

Figure 3:
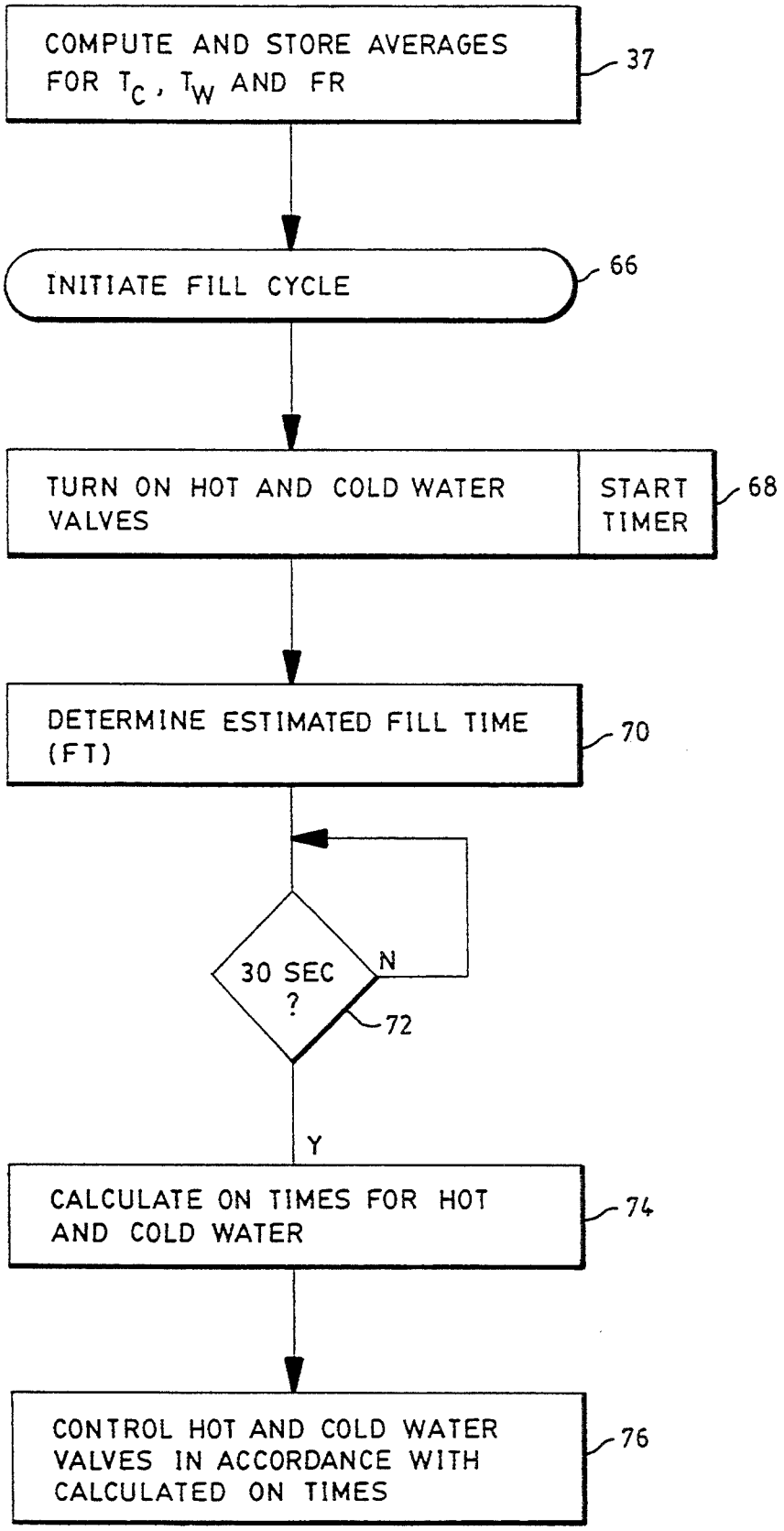
FIG. 3 is a flow diagram of the water fill portion of the controller of FIG. 2.

Referring to FIG. 3, a flow diagram shows that portion of the operation of controller 36 that relates to water fill system 34. In the initial step 37, controller 36 COMPUTEs AND STOREs AVERAGES FOR $T_C$, $T_W$, AND FR. In particular, $T_C$ is the cold water temperature, $T_W$ is the warm water temperature, and FR is the flow rate of water from mixing valve 38 into wash tub 32. Each of these parameters is provided with an initial default value when controller 36 is initially turned on. For example, household cold water typically may vary from 45° F. in the winter to 65° F. in the summer. Therefore, a mid-range temperature of 55° F. may typically be selected as the initial cold water temperature default value which is stored in register 40. A thermistor 42 is embedded in the mixing valve 38 to provide the controller 36 with signal indicating the temperature of the water flowing from mixing valve 38. Controller 36 monitors the temperature of cold water flowing through mixing valve 38 during a plurality of washing operations, and updates register 40 with an average of the cold water temperature $T_C$. For example, controller 36 may record the temperature of thermistor 42 at some portion of a wash or rinse fill operation when only cold water is flowing through mixing valve 38, and then average three or more of these recorded values for $T_C$ to obtain the average cold water temperature which is then used to update the value stored in register 40.

The warm water temperature $T_W$ is here defined as the temperature of a mixture of 50% hot water and 50% cold water. A typical household may set the hot water heater (not shown) to 130° F. Because a 50/50 mixture of cold water at 55° F. and hot water at 130° F. would yield a warm water temperature $T_W$ of 92.5° F., this may typically be a good selection for an initial default value for register 44 that stores $T_W$. The warm water temperature $T_W$ is measured by controller 36 first turning on the hot water valve 46 and cold water valve 48 for a predetermined period such as 30 seconds at the beginning of a fill operation to purge the hot water line 50 and cold water line 52 of water at ambient temperature. Then, controller 36 uses thermistor 42 to obtain a measure of $T_W$ which is the temperature of the water flowing through mixing valve 38 at that time. The warm water temperature $T_W$ is measured at the beginning of or during a plurality of fill operations when both valves 46 and 48 are on and purged, and an average value is stored in register 44. It is recognized that the ratio of hot to cold water may not be precisely 50/50, but the accuracy of subsequent calculations using such assumption has been found to be is acceptable.

An initial default value of 3 gallons per minute may typically be stored in register 54 for the flow rate FR from mixing valve 38. This value is subsequently updated with an average of actual measured data derived in the following manner. Wash tub 32 is here illustratively shown to have a plurality of pressure sensors 56*a–e* disposed at various levels. In actual practice, it may be preferable to use a conventional multiple-position pressure sensitive switch at the bottom of wash tub 32 to provide respective output signals corresponding to different fill levels. Pressure sensor 56*a* is positioned at the lowest level, and here provides an output indicating when water is filled to the 9.95 gallon level. Pressure sensor 56*b* is positioned at the next lowest level, and here provides an output indicating when water is filled to the 12.8 gallon level. Similarly, pressure switches 56*c–e* provide outputs indicating when water is filled to the 15.65, 18.32 and 21 gallon levels, respectively. Controller 36 starts a timer 58 when a fill operation is initiated. The fill rate FR is calculated by determining how long it takes to fill to a particular pressure sensor 56*a–e*, and then dividing the gallons required to fill to that particular level by that measured time to fill to that level. Measurements may also be taken between sensors 56*a–e*. A plurality of measurements may be taken on each fill operation, or over a plurality of fill operations to arrive at an average fill rate FR which is used to update register 54. Registers 40, 44, and 54 may typically take the form of software storage locations where $T_C$, $T_W$, and FR are stored.

Referring again to FIG. 2, a flow washer 60 is included in mixing valve 38 to minimize the effect of inlet or line water pressure on flow rate FR into wash tub 32. It is recognized that even though flow washer 60 is used, the flow rate FR will still vary as a function of inlet water pressure. For example, in one embodiment, the flow rate FR may vary from approximately 3 gallons per minute at 30 psi for cold and warm water to slightly above 4 gallons per minute at 90 psi. For simplicity, however, the process herein assumes that the fill or flow rate FR is constant regardless of the inlet pressure, and whether both hot and cold valves 46 and 48 are open, or only one.

Still referring to FIG. 2, a WASH INITiate command is input to controller 36 from control knob 28*e* once the water level and temperatures for the wash and rinse cycles have been input with control knobs 28*a–d*. In response thereto, the next step is for controller 36 to INITIATE FILL CYCLE as shown in step 66 of FIG. 3. The following discussion is also applicable to a fill operation for rinsing. As shown in step 68, controller 36 operates to TURN ON HOT AND COLD WATER VALVES 46 and 48 respectively, and also to START TIMER 58. As indicated by step 70, controller 36 operates to DETERMINE ESTIMATED FILL TIME (FT). The desired wash level V is input by the operator through control knob 28*b* (or 28*d* for a rinse operation), and the average fill rate FR is known and stored in register 54 from a history of fill rates FR as discussed above. In accordance with the known characteristics of the particular wash tub 32 being used, the desired wash level V is readily convertible into gallons. The fill rate is in gallons per minute, so the fill time FT can readily be determined by:

$$FT = V/FR \qquad \text{Eq. 1}$$

For example, if the operator has selected a medium wash level which equates to 15 gallons and the average measured fill rate FT as stored in register 54 had previously been determined to be 3 gallons per minute, the fill time FT would be determined to be 5 minutes. Fill rate FR could also be subsequently updated during the present fill cycle for increased accuracy.

As indicated by step 72, controller 36 monitors timer 58 to determine when 30 SEConds has elapsed from turning on both hot and cold valves 46 and 48. During this 30 second interval, the hot and cold water feed lines 50 and 52 are purged of water at ambient temperature to provide an accurate measurement of the warm water temperature $T_W$ which is here assumed to be 50% hot water and 50% cold water.

As indicated by step 74, the next step is for controller 36 to CALCULATE ON TIMES FOR HOT AND COLD WATER to attain the desired or preselected water temperature $T_V$. The final mix temperature $T_V$ for a volume of water is equal to the cold water temperature $T_C$ plus the difference between the hot water temperature $T_H$ and the cold water temperature $T_C$ times the fraction of hot water in the final volume. That is, $$T_V = T_C + (T_H - T_C)*(V_H\%/100\%) \qquad \text{Eq. 2}$$

where $T_V$=total volume water temperature desired in tub;

$T_H$=hot water temperature;

$T_C$=cold water temperature; and $V_H\%$=percentage of total volume that is hot water.

After rearranging, $$V_H\% = ((T_V - T_C)/(T_H - T_C))*100\% \qquad \text{Eq. 3}$$

The hot water temperature $T_H$ is not directly measurable by the single thermistor 42 embedded in the mixing value 38 because there may not be any time when only hot water is running. Therefore, the hot water temperature $T_H$ is determined from the hot/cold mixed water temperature $T_W$ in the following manner. Because it is assumed that the mixed water includes 50% hot water and 50% cold water, equation 3 above can be solved by setting $V_H$=50%. That is, $$50\% = (T_W - T_C)/(T_H - T_C)*100\% \qquad \text{Eq. 4}$$

and solving, $$T_H = 2T_W - T_C \qquad \text{Eq. 5}$$

Now, substituting equation 5 into equation 3 for $T_H$, $$V_H\% = ((T_V - T_C/(2T_W - 2T_C))*100\% \qquad \text{Eq. 6}$$

Because all the variables are known, the percentage of hot water $V_H\%$ in the desired mix is readily calculated using equation 6. That is, the desired final wash or rinse temperature $T_V$ is input by the operator; the cold water temperature $T_C$ is obtained from register 40 as an average of past cold temperatures; and the warm water temperature $T_W$ is obtained from register 44 as an average of past warm water temperatures, or, more preferably, as updated using a warm water temperature $T_W$ as measured during the present fill operation after feed lines 50 and 52 have been purged for 30 seconds. In particular, rather than merely using a real time value for $T_W$, it may be preferable to average the real time value with two values of historical data to help compensate for real time fluctuations. Alternately, a look-up table may be used instead of calculating the hot water percentage using equation 6.

Under the assumptions discussed herein, the fill volume is directly related to time. Thus, the hot and cold on times are calculated using the following formulas:

$$\text{HOT WATER ON TIME}=(V_H\%/100\%)(FT) \quad \text{Eq. 7}$$

$$\text{COLD WATER ON TIME}=(1-(V_H\%/100\%))(FT) \quad \text{Eq. 8}$$

As indicated by step 76, controller 36 then controls hot and cold water valves 46 and 48, respectively, in accordance with the calculated on times. For example, assuming that the hot water on time was calculated to be 3 minutes by equation 7 and the cold water on time was calculated to be 4 minutes using equation 8, the controller 36 would open hot water valve 46 for 3 minutes and then the cold water valve 48 for 4 minutes. Under such conditions, valves 46 and 48 would be open sequentially for a sum of 7 minutes thereby satisfying the preselected level V requirement, and also the preselected temperature requirement would be satisfied by the resulting mixture ratio.

Because the flow rate FR has been assumed to be constant regardless of whether one or both water valves 46 and 48 are on, the fill time FT will always be 7 minutes for the example above. However, it may be desirable to turn on both hot and cold water valves 46 and 48 simultaneously. For such arrangement, the simultaneous on times would be calculated according to the following formula:

$$\text{WARM TIME}=FT-|\text{COLD WATER ON TIME}-\text{HOT WATER ON TIME}| \quad \text{Eq. 9}$$

where warm time is the simultaneous on time, FT is the total fill time, and the absolute value of the cold water time less the hot water time is subtracted therefrom. For the example above, the absolute value of 4−3 is 1, so the warm time would be 7−1, or 6 minutes. Then, after the hot water is turned off, the cold water is left on for another minute to satisfy the total on time of 7 minutes.

It may be desirable to use pressure sensors 56*a–e* as a cross-correlation for the fill time FT. For example, if the preselected level through control knob 28*b* was for a medium wash load level V that corresponds to 15.65 gallons, and the level sensor 56*c* also corresponds to 15.65 gallons, then theoretically the pressure sensor 56*c* should provide an output signal at the completion of the fill time FT. If pressure sensor 56*c* does not provide an output signal at the designated time, there may a filling anomaly such as a broken hose or clogged water filter screen, or the accuracy of the fill rate FT may be off. It may be desirable for controller 36 to turn on hot and cold water valves 46 and 48 until a fill level signal is received from the corresponding pressure sensor, here 56*c*. If the additional time is small, it may be indicative that the fill rate FR was not accurate, in which case the value in register 54 can be suitably adjusted. Conversely, if more than a small amount of additional time is required, that may mean that there is a filling anomaly in which case a water valves 46 and 48 would be closed and a diagnostic alarm sounded.

In summary, controller 36 uses a thermistor 42 embedded in the mixing valve 38 to determine historical averages of the cold water temperature $T_C$ and warm water temperature $T_W$ which is assumed to be a 50/50 mix of hot and cold water. After suitably updating the warm water temperature $T_W$ with real time data after purging the hot and cold water lines, the hot water temperature is readily calculated from the cold and warm water temperatures. Controller 36 also uses timer 58 and pressure sensors 56*a–e* practically implemented as a multi-position pressure switch to determine a historical average of the flow rate FR into wash tub 32. The use of a flow washer 60 helps to justify the assumption that the flow rate is constant regardless of whether one or both of the water valves 46 and 48 are on. The desired wash temperature and level is input by the operator, and the level is readily converted to gallons. Based on the hot and cold water temperatures and the anticipated flow rate, controller 36 calculates the ratio of hot and cold water, and how long each must be turned on to provide the selected water level. That is, the filling parameters are known at the beginning or shortly into a fill cycle after the water lines 50 and 52 have been purged. Then, each water valve 46 and 48 is turned on for a single extended on cycle to satisfy the final requirements of temperature and level. The ratio of hot and cold water can theoretically be adjusted to any value between all hot and all cold, so the temperature can theoretically be regulated to any value between hot and cold. Further, because the water valves are only cycled on once, problems associated with cycling such and water hammer and wear are greatly diminished. Also, a cross-check between the measured fill rate FR and pressure sensors 56*e* can be used for diagnostic analysis.

This concludes the description of the Preferred Embodiment. A reading of it by one skilled in the art will bring to mind many alterations and modifications that do not depart from the spirit and scope of the invention. Therefore, it is intended that the scope of the invention be limited only by the appended claims.

What is claimed is:

1. In an automatic clothes washer having a wash tub filled by hot and cold water provided through respective hot and cold water valves, a method of filling the wash tub to a preselected level with water at a preselected temperature, comprising the steps of:

determining the time to fill the wash tub to said preselected level with a predetermined water flow rate;

determining respective on times of hot and cold water at predetermined temperatures to provide a mixture at said preselected temperature; and turning on said hot and cold water valves in accordance with said respective on times to fill said wash tub to said preselected level with water at said preselected temperature.

2. The method recited in claim 1 wherein said step of determining the time to fill the wash tub comprises a step of determining said predetermined water flow rate by measuring the time to fill to a sensed water level of known water volume on a previous fill operation, and dividing the known water volume by the measured time to fill to the sensed level.

3. The method recited in claim 2 wherein said step of determining the time to fill the wash tub further comprises a step of averaging a plurality of measured flow rates, and storing the average flow rate as said predetermined water flow rate.

4. The method recited in claim 1 wherein said step of determining hot and cold water on times comprises a step of generating said predetermined hot and cold temperatures by measuring the temperature of water at an outlet of a mixing valve when only cold water is running and when a mixture of hot and cold water is running, and calculating the predetermined hot water temperature from the cold and mixture water temperatures.

5. The method recited in claim 4 further comprising a step of purging water lines before measuring the mixture water temperature.

6. The method recited in claim 2 wherein said step of determining the time to fill the wash tub further comprises a step of dividing a water volume corresponding to the preselected level by said predetermined water flow rate.

7. The method recited in claim 1 wherein said step of determining hot and cold water on times comprises a step of determining the percentages of hot and cold water at said respective predetermined temperatures that would yield a mixture at said preselected temperature.

8. The method recited in claim 7 wherein said step of determining hot and cold water on times comprises a step of multiplying said hot and cold water percentages times said time to fill said tub to said preselected level.

9. The method recited in clam 1 further comprising a step of an operator selecting said preselected water level and temperature.

10. An automatic clothes washer comprising:

a wash tub;

hot and cold water valves for filling said wash tub with hot and cold water;

operator actuable means for selecting a desired water level and temperature;

means for determining the time to fill said wash tub to a selected level with a predetermined water flow rate;

means for determining respective on times of hot and cold water at predetermined temperatures to provide a mixture at a selected temperature; and means for turning on said hot and cold water valves in accordance with said respective on times to fill said wash tub to said selected level with water at said selected temperature.

11. The clothes washer recited in claim 10 wherein said means for determining the time to fill said wash tub comprises means for determining said predetermined water flow rate by measuring the time to fill to a sensed water level known volume on a previous fill operation, and dividing the known water volume by the measured time to fill to the sensed water level.

12. The clothes washer recited in claim 11 wherein said means for determining the time to fill said wash tub further comprises means for averaging a plurality of measured flow rates, and storing the average flow rate as said predetermined water flow rate.

13. The clothes washer recited in claim 11 wherein said means for determining the time to fill said wash tub further comprises means for dividing a water volume corresponding to the preselected level by said predetermined water flow rate.

14. The clothes washer recited in claim 10 wherein said means for determining hot and cold water on times comprises means for determining the percentages of hot and cold water at said respective predetermined temperatures that would yield a mixture at said selected temperature.

15. The clothes washer recited in claim 14 wherein said means for determining hot and cold water on times comprises means for multiplying said hot and cold water percentages times said time to fill said tub to said preselected level.

16. An automatic clothes washer comprising:

a wash tub having a first sensor for providing an output signal indicating a predetermined water level;

a mixing valve comprising hot and cold water valves for filling said wash tub with water, said mixing valve having a second sensor for providing a signal indicating the temperature of outlet water from said mixing valve;

an operator actuable control for providing signals indicating a desired water temperature and water level;

a controller coupled to receive said first and second sensor signals and said operator actuable control signals, said controller comprising means responsive to said signals for determining in advance the on times of said hot and cold water valves to provide the desired water temperature and level, and opening said hot and cold water valves in accordance with said determined on times; and said controller determining means comprising means responsive to said first sensor and a timer for generating and storing a historical average of flow rate through said mixing valve.

17. The clothes washer recited in claim 16 wherein said first sensor comprises a pressure sensitive switch.

18. The clothes washer recited in claim 16 wherein said second sensor comprises a thermistor.

19. The clothes washer recited in claim 16 wherein said controller determining means comprises means responsive to said second sensor for generating and storing historical averages for cold water temperature and warm water temperature wherein warm water is assumed to be a 50/50 mixture of hot and cold water.

20. The clothes washer recited in claim 19 wherein said controller determining means further comprises means responsive to said cold and warm water averages for calculating a hot water temperature.

21. The clothes washer recited in claim 20 wherein said controller determining means further comprises means responsive to said desired temperature and said hot and cold water temperatures for determining a mixture ratio of hot and cold water to produce said desired temperature.

22. The clothes washer recited in claim 16 wherein said mixing valve has a flow washer to minimize change in flow rate as a function of inlet pressure to said mixing valve.

23. The clothes washer recited in claim 22 wherein said controller determining means comprises means responsive to said flow rate average and said desired water level signal for determining a time to fill said wash tub to said desired level.

* * * * *